United States Patent [19]

Keikichi et al.

[11] 4,056,753

[45] Nov. 1, 1977

[54] OVERVOLTAGE PROTECTING ELEMENT

[75] Inventors: Tsukioka Keikichi; Takayanagi Yukio, both of Sagamihara, Japan

[73] Assignee: Kabushiki Kaisha Sankosha, Tokyo, Japan

[21] Appl. No.: 657,858

[22] Filed: Feb. 13, 1976

[51] Int. Cl.[2] ..... H01J 17/00; H01J 21/00

[52] U.S. Cl. ..... 313/325; 313/218; 313/306; 361/117

[58] Field of Search ..... 315/35, 36; 317/61, 317/62; 313/325, 326, 306, 218, 217

[56] References Cited

U.S. PATENT DOCUMENTS

| | | | |
|---|---|---|---|
| 3,454,811 | 7/1969 | Scudner, Jr. | 317/62 X |
| 3,588,576 | 6/1971 | Kawiecki | 313/325 |
| 3,885,203 | 5/1975 | Baker et al. | 313/231.1 |
| 3,959,696 | 5/1976 | Lange et al. | 313/218 |
| 3,979,646 | 9/1976 | Peche et al. | 313/306 |

*Primary Examiner*—Saxfield Chatmon, Jr.

[57] ABSTRACT

An overvoltage protecting element comprises a hollow cylinder of an insulating material, a pair of electrodes sealed to the opposite ends of the cylinder, and a pair of conductive layers disposed on the inner wall of the cylinder so as to be located opposite to the respective electrodes and each having a projection which extends toward the electrode. The conductive layers are of the band type, and one or more projections are provided on a part thereof. In order to prevent deterioration of insulation resistance by repeated discharge, the conductive layers are provided at positions which are electrically insulated from the two main electrodes.

5 Claims, 7 Drawing Figures

OVERVOLTAGE PROTECTING ELEMENT

BACKGROUND OF THE INVENTION

The invention relates to an overvoltage protecting element of a gaseous discharge tube type which improves a time lag on the commencement of a discharge in response to the application of an overvoltage.

An overvoltage protecting element of the type described involves a time lag in its discharge when an overvoltage is applied thereto, thereby giving rise to a residual voltage. Efforts have been directed heretofore at minimizing such time lag as by enclosing radioisotope in gaseous form in a discharge element or mixing it with a suitable binder to be disposed on the inner wall of the discharge element. However, the attempt at minimizing the time lag in the discharge of the element through the use of such radioisotope failed to provide a satisfactory result in that (1) an increase in the amount of radioisotope added results in a saturation of the intended effect; (2) the amount of radioisotope which can be enclosed in a single discharge element is constrained by the law regulation, and a variety of security and maintenance requirements are imposed on the manufacturing equipment; (3) a repeated discharge operation causes the electrode material to be sputtered onto the inner wall of the discharge element to be deposited over the radioisotope applied, thus reducing its effect; (4) the effect of the radioisotope decreases according to its half-life; and (5) there is a possibility of pollution.

As an alternative to the use of the radioisotope, U.S. Pat. No. 3,588,576 discloses a spark-gap device comprising a pair of main electrodes, a tube of an insulating material such as ceramic or glass which holds the main electrodes in position and establishes a discharge space which is isolated from the environment and which is filled with a gas, and a narrow conductive layer disposed on the inner surface of the tube in electrical contact with one of the main electrodes and extending toward the other electrode. A region of concentrated potential gradient is formed on the surface of the insulating material to cause a creeping discharge from the edge of the layer along the inner wall of the tube which produces an ionization effect, thereby promoting a discharge across the main electrodes. In this manner, the discharge surface of the main electrodes are bombarded with ions. However, in an overvoltage protecting element of this type, if a discharge of an increased current frequently occurs across the pair of main electrodes, the electrode material will be sputtered to form a thin annular conductive layer on the inner wall of the tube around the electrodes, and thin conductors may communicate with each other to cause a degradation in the insulating characteristic of the element.

SUMMARY OF THE INVENTION

It is a primary object of the invention to provide an overvoltage protecting element which prevents a degradation of the insulating characteristic during use.

It is another object of the invention to provide an overvoltage protecting element capable of substantially minimizing a time lag in the initiation of a discharge.

Figure 1A:
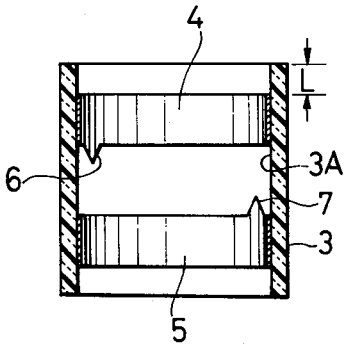
FIG. 1A is a schematic longitudinal section of the overvoltage protecting element according to the invention, with the main electrodes removed.
Figure 1C:
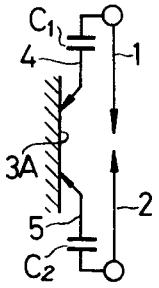
FIG. 1C is a circuit diagram illustrating an electrical equivalent circuit of the element shown in FIG. 1B.
Figure 1B:
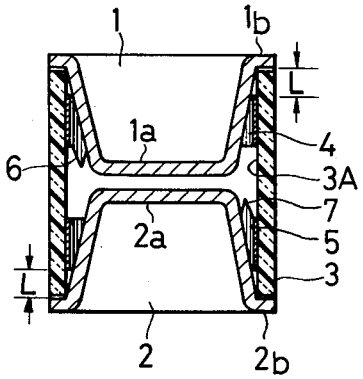
FIG. 1B is a longitudinal section of the overvoltage element complete with the main electrodes, as taken along a different section plane.

DETAILED DESCRIPTION OF EMBODIMENTS:

Referring to the drawings, and particularly to FIGS. 1A to 1C, the overvoltage protecting element according to one embodiment of the invention includes a pair of frusto-conical main electrodes 1, 2 having a flat bottom 1*a*, 2*a* and an outwardly extending flange 1*b*, 2*b*, which are firmly held against and sealed to the opposite end faces of a hollow cylinder 3 formed of an insulating material such as ceramic or glass. A pair of annular conductive layers 4, 5 are applied to the inner wall of the cylinder 3 at a given spacing of L from the end thereof. The conductive layers 4, 5 are spaced from each other by a given distance. The conductive layers 4, 5 are each formed with at least one projection 6, 7, respectively, on the edges which are located opposite to each other. The bottoms 1*a*, 2*a* of the main electrodes are also spaced apart by a given distance, and the conical surface of the main electrode 1 extending between the bottom 1*a* and the flange 1*b* is disposed in opposing relationship with the conductive layer 4 at a given spacing therefrom as is the conical surface of the main electrode 2 with the conductive layer 5. A dielectric gas is filled in the interior space defined by the electrodes 1, 2 and the tube 3, and capacitors are formed between the layers 4, 5 and the electrodes 1, 2, respectively.

The electrical equivalent circuit of the arrangement is shown in FIG. 1C where $C_1$ and $C_2$ represent a distributed capacitance formed between the conductive layer 4 and the main electrode 1 and between the conductive layer 5 and the main electrode 2, respectively.

When a voltage surge is applied across the electrodes 1, 2, it will be applied to the projection 6 through the capacitance $C_1$ and the conductive layer 4, whereby a creeping discharge will occur from the pointed end of projection 6 toward the inner wall 3A of the cylinder 3 to cause the ionization of the gas to induce an ion bombardment, which promotes a discharge across the electrodes 1, 2, thus reducing a time lag in the commencement of the discharge. The presence of the capacitances $C_1$ and $C_2$ prevents a degradation in the insulating property across the electrodes 1, 2 or across the conductive layers 4, 5 which might otherwise occur as mentioned previously, as a result of the deposition of fine particles of the electrode material which are sputtered to the inner wall 3A of the cylinder 3 intermediate these main electrodes when a discharge of an increased current frequently occurs across the main electrodes. The insulating property is also maintained by the presence of the spacing L, which is removed and shielded from the discharge space across the main electrodes to prevent any deposition of sputtered particles thereon.

Figure 2B:
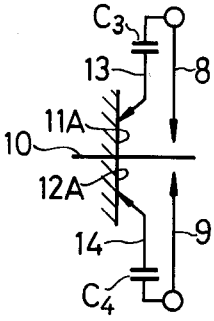
FIG. 2B is a circuit diagram showing an electrical equivalent circuit of the element shown in FIG. 2A.
Figure 2A:
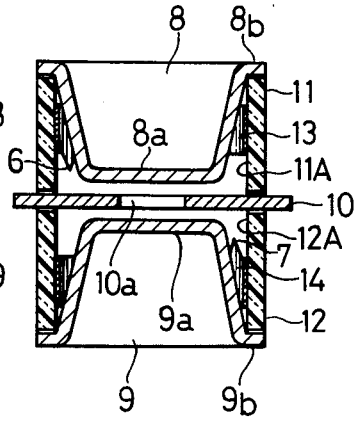
FIG. 2A is a longitudinal section of the overvoltage protecting element constructed in accordance with another embodiment of the invention.

FIG. 2A shows another embodiment of the overvoltage protecting element according to the invention which is constructed as a three electrode structure. Specifically, the element includes a first main electrode 8 and a second main electrode 9, which are constructed in the similar manner as illustrated in FIG. 1B, and also includes a third main electrode 10 which is interposed between and spaced from bottoms 8a and *9a* of the first and second main electrodes 8, 9, thus forming a pair of discharge gaps between these electrodes. The third electrode 10 is disposed and clamped between a pair of cylinders 11, 12 and has its opposite ends projecting externally of these cylinders. The third electrode 10 is centrally formed with an opening 10*a*. A conductive layer 13 is applied to the inner wall of the first cylinder 11, and the conical surface of the first main electrode 8 which extends between its bottom 8*a* and flange 8*b* is disposed in opposing relationship with the conductive layer 13. In the similar manner, a conductive layer 14 is applied to the inner wall of the second cylinder 12, and the conical surface of the second main electrode 9 which extends between its bottom 9*a* and flange 9*b* is disposed in opposing relationship the conductive layer 14. The interior space defined by the electrodes 8, 9 and 10 and the cylinders 11, 12 is filled with a dielectric gas. The conductive layer 13 is spaced by a given distance from the end of the first cylinder 11 which is sealed by the flange 8*b* of the first main electrode 8, and similarly the conductive layer 14 is spaced by a given distance from the end of the second cylinder 12 which is sealed by the flange 9*b* of the second main electrode 9. Each of the conductive layers 13, 14 is provided with a projection which extends toward the third electrode 10, in the similar manner as mentioned above in connection with FIG. 1.

The element shown in FIG. 2 is adapted to be connected across a pair of lines, one of which is connected with the first main electrode 8 and the other of which is connected with the second main electrode 9, while the third electrode 10 is connected with the ground so as to bypass a voltage surge from the lines.

The electrical equivalent circuit of the arrangement shown in FIG. 2A is illustrated in FIG. 2B, which is similar to that shown in FIG. 1C and hence will not be specifically described except to add that a reference character 11A represents the inner wall of the first cylinder 11 and 12A the inner wall of the second cylinder 12. An additional difference resides in the fact that the third electrode 10 is not provided with any conductive layer. However, a conductive layer may be provided so as to be electrostatically coupled with the third electrode.

In the above described embodiments, each conductive layer has been described as being provided with a single projection, but it should be understood that it may be formed with a plurality of projections. In contradistinction to the U.S. patent quoted above the creeping distance may be reduced as compared with the gap length for the main discharge. Additionally, while it is preferable that each of the conductive layers be annular in configuration, extending around the entire periphery of the cylinder, the conductive layer may extend around part of the circumference of the cylinder, provided it has a suitable length.

Figure 3:
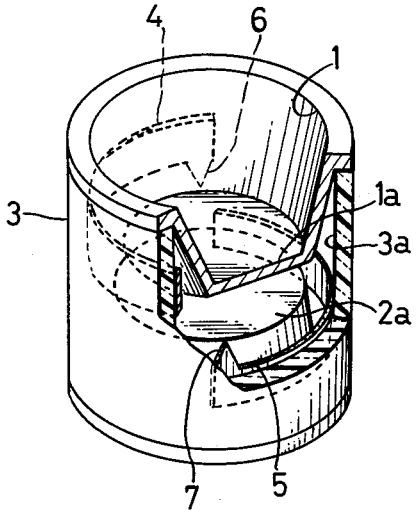
FIG. 3 is a perspective view, partly in longitudinal section, of a further embodiment of the invention.
Figure 4:
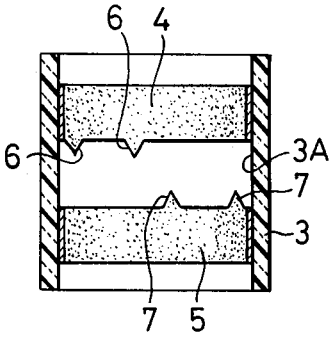
FIG. 4 is a longitudinal section of the overvoltage protecting element according to the invention, with the main electrodes removed and showing a plurality of projections of the conductive layers.

Such an arrangement is shown in FIG. 3 where similar parts as shown in FIGS. A to C are designated by like reference characters. As will be evident, the curved band-like conductive layers 4, 5 extend around one-half the inner periphery of the tube 3 and are spaced from each other in the axial and circumferential directions thereof. While not shown, these conductive layers may extend over an arc subtending an angle of 120°.

It is preferred that each conductive layer has an increased width to provide an increased capacitance and that the spacing L be reduced as much as possible, but the width of the conductive layers and the spacing L are determined in consideration of the insulating requirement.

While specific embodiments of the invention have been shown and described, it should be understood that various changes and modifications will readily occur to those skilled in the art without departing from the spirit of the invention, and therefore it is intended that the scope of the invention be solely limited by the appended claims.

What is claimed is:

1. An overvoltage protecting element comprising:

a hollow cylinder formed of an insulating material;

a pair of main electrodes sealed to the opposite ends of the cylinder so as to close openings at the opposite ends thereof, said main electrodes being frusto-conical in configuration and having a flat bottom, the bottom of one of the electrodes being disposed in opposing relationship with, and spaced a given distance from, the bottom of the other electrode; and a pair of conductive layers disposed on the inner wall of the cylinder in opposed and spaced relationship with a different one of the main electrodes, said conductive layers being separated from each other by a space and being electrically insulated the main electrodes, each of said conductive layers having at least one projection which extends toward the other main electrode, said conductive layers extending around the inner wall of the cylinder over an angle not greater than 360° and being spaced from each other in the axial and circumferential directions of the cylinder.

2. An overvoltage protecting element according to claim 1 in which each of the conductive layers has a plurality of projections.

3. An overvoltage protecting element comprising a first hollow cylinder formed of an insulating material, a first main electrode sealed to one end of the first cylinder, a second hollow cylinder formed of an insulating material and disposed in axial alignment with and abutment against the first cylinder, a second main electrode sealed to one end of the second cylinder which is remote from the first cylinder, a third main electrode disposed between the other end of the first cylinder and the other end of the second cylinder, a first conductive layer disposed on the inner wall of the first cylinder in opposed and spaced relationship with the first main electrode and having a projection which extends toward the third main electrode, and a second conductive layer disposed on the inner wall of the second cylinder in opposed and spaced relationship with the second main electrode and having a projection which extends toward the third main electrode.

4. An overvoltage protecting element according to claim 3 in which each of the first and second main electrodes is frusto-conical in configuration and the third main electrode is in the form of a disc.

5. An overvoltage protecting element according to claim 3 in which each of the first and second conductive layers has a plurality of projections which extend toward the third main electrode.

* * * * *